US011692400B2

(12) United States Patent
Cammack et al.

(10) Patent No.: US 11,692,400 B2
(45) Date of Patent: Jul. 4, 2023

(54) FORMATION EVALUATION BASED ON PULSE POWER ELECTRODE DISCHARGE MEASUREMENTS

(71) Applicant: Halliburton Energy Services, Inc., Houston, TX (US)

(72) Inventors: Matthew Eugene Cammack, Houston, TX (US); Boguslaw Wiecek, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 31 days.

(21) Appl. No.: 17/211,817

(22) Filed: Mar. 24, 2021

(65) Prior Publication Data

US 2022/0307323 A1 Sep. 29, 2022

(51) Int. Cl.

| | |
|---|---|
| ***E21B 7/15*** | (2006.01) |
| ***E21B 49/00*** | (2006.01) |
| ***E21B 44/00*** | (2006.01) |

(52) U.S. Cl.

CPC ..... *E21B 7/15* (2013.01); *E21B 44/00* (2013.01); *E21B 49/003* (2013.01)

(58) Field of Classification Search

CPC ..... E21B 49/003; E21B 7/17

See application file for complete search history.

(56) References Cited

U.S. PATENT DOCUMENTS

| | | | |
|---|---|---|---|
| 5,278,758 | A | 1/1994 | Perry et al. |
| 2009/0050371 | A1 | 2/2009 | Moeney |
| 2013/0032404 | A1 | 2/2013 | Donderici et al. |
| 2013/0069656 | A1 | 3/2013 | Haramboure et al. |
| 2018/0034280 | A1 * | 2/2018 | Pedersen ..... E21B 41/00 |
| 2020/0370375 | A1 | 11/2020 | Gleitman et al. |

FOREIGN PATENT DOCUMENTS

WO WO-2019245542 A1 * 12/2019 ..... E21B 44/00

OTHER PUBLICATIONS

PCT Application No. PCT/US2021/024256, International Search Report, dated Dec. 15, 2021, 5 pages.
PCT Application No. PCT/US2021/024256, Written Opinion, dated Dec. 15, 2021, 5 pages.

* cited by examiner

*Primary Examiner* — Kristyn A Hall
(74) *Attorney, Agent, or Firm* — Delizio, Peacock, Lewin & Guerra

(57) ABSTRACT

A first characteristic of a first discharge of electrodes of a pulse power drilling assembly in a borehole of a subterranean formation is determined. The first characteristic is based on a measurement of the first discharge. A second characteristic of a second discharge of the electrodes is determined. The second discharge occurs after the first discharge, and the second characteristic is based on a measurement of the second discharge. A difference between the first characteristic and the second characteristic is determined. A boundary layer of the subterranean formation is determined based on the difference.

19 Claims, 8 Drawing Sheets

FORMATION EVALUATION BASED ON PULSE POWER ELECTRODE DISCHARGE MEASUREMENTS

TECHNICAL FIELD

The disclosure generally relates to pulse power drilling operations including formation evaluation based on measurements of discharge from electrodes of a pulse power drilling assembly.

BACKGROUND

Pulse power drilling entails using electrical pulsing in which a high-power electrical discharge is periodically emitted into the formation for drilling. The process includes transmission of high energy/power that is generated, stored, and periodically electrically discharged as pulses by a downhole pulse generator. Electrodes disposed on a pulse power drill head at the bottom of a pulse power drilling string emit the electrical discharges into the subsurface formation rock. Each discharge is designed to generate a high energy fluid in the form of a plasma in formation material at the bottom surface of a borehole. The plasma is a highly conductive, ionized gas containing free electrons and resultant positive ions from which the electrons have been disassociated. The injected energy carried by the plasma is expended as a mechanical fracturing force by heating the formation fluids within the formation material. In this manner, the high-energy discharges generate high internal pressure with rock material to fracture the rock by internal tension.

BRIEF DESCRIPTION OF THE DRAWINGS

Embodiments of the disclosure may be better understood by referencing the accompanying drawings.

DESCRIPTION OF EMBODIMENTS

Figure 1:
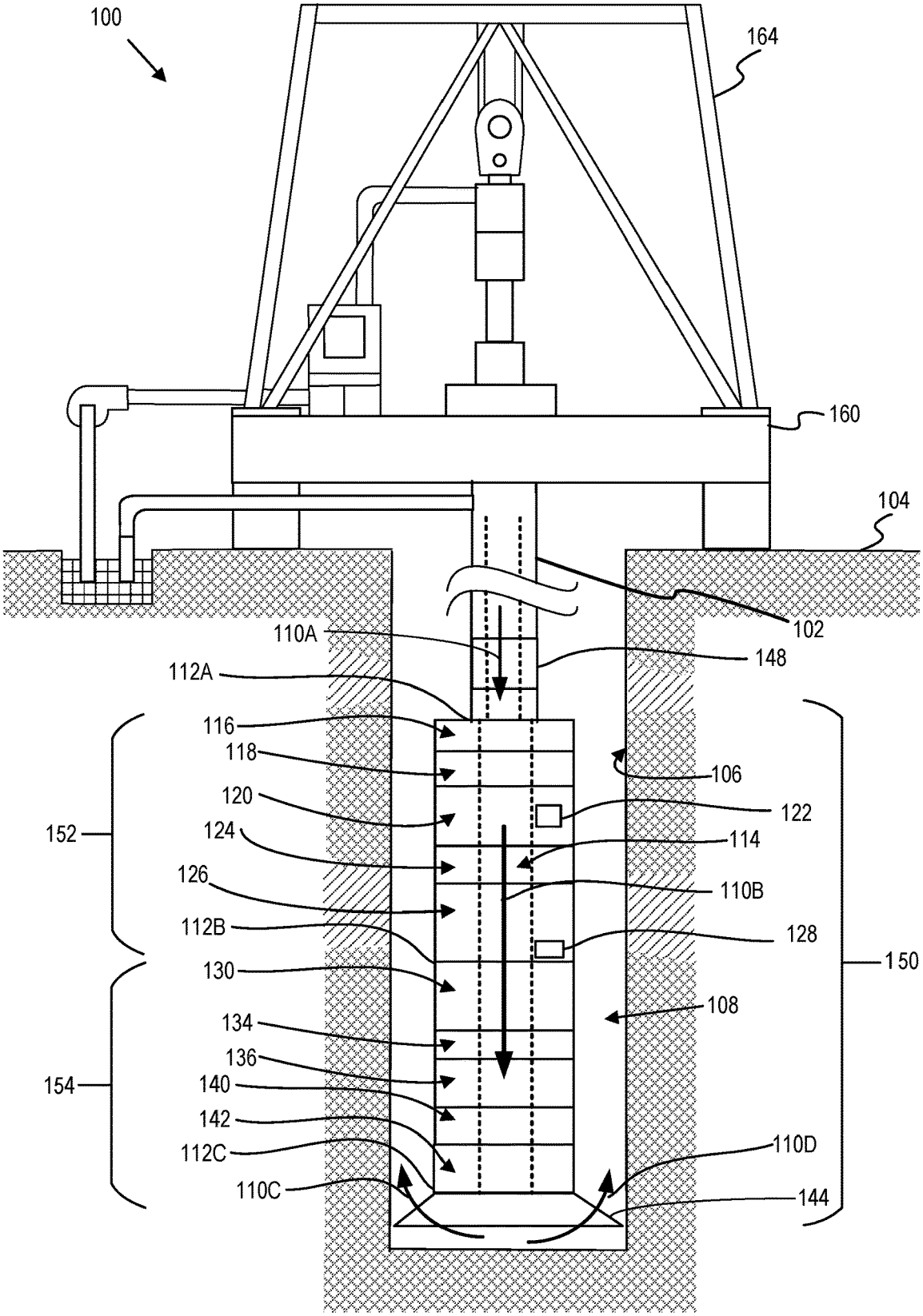
FIG. 1 illustrates an example pulse power drilling system, including a pulse power drilling assembly positioned in a borehole and secured to a length of drill pipe coupled to a drilling platform and a derrick, according to various embodiments.

The description that follows includes example systems, methods, techniques, and program flows that embody embodiments of the disclosure. However, it is understood that this disclosure may be practiced without these specific details. In other instances, well-known instruction instances, protocols, structures and techniques have not been shown in detail in order not to obfuscate the description.

Overview

During pulse power drilling operation, electrodes emit pulses of electrical energy, or discharges, to extend a borehole into a subterranean formation. Characteristics of these discharges can be measured. The characteristics can be analyzed to provide further information about the subterranean formation and to guide further pulse power drilling operations. By analyzing characteristics of discharges of electrodes of using sensors attached at or near the face of the electrodes, additional tools are not required to be run downhole for formation evaluation techniques. Additionally, by obtaining measurements at or near the face of the electrodes, which are located at the bottom of the assembly, the assembly receives and processes measurements without the delay associated with traditional logging while drilling tools, which are located behind the bit and may lag significantly during normal operations. This allows changes in the formation to be detected and appropriate operation control actions to be taken sooner than traditional implementations.

Embodiments of the assembly may include a plurality of computing devices, such as microprocessors and associated electronic circuitry, which may receive one or more signals from one or more sensors included as part of the assembly. The signals may be received in real time and correspond to one or more measured parameters associated with the operation of the assembly as part of a borehole advancement procedure. The information included in the received signals may be further processed by the computing device(s) included in the assembly and may be stored for logging purposes and/or utilized for further control of the operations of the assembly as part of the borehole advancement procedure currently being performed by the assembly.

In various embodiments, one, some, or all of these controllers may operate as a control module configured to receive various signal, for example from sensors located on or within the assembly, the signals including sensed measurements of operating parameters associated with the operation of the assembly. The control module may further process and store information related to these received signal, and/or may further process these signals and provide information and/or output control commends to further control the operation of the assembly based at least in part on the information included in the received signals. For example, measurements of current and/or voltage levels associated with the discharges occurring at the electrode face of the assembly may be used for formation evaluation. These measurements of the current/voltage discharges occurring at the electrode can also be used as part of steering control for the assembly.

Example Illustrations

FIG. 1 illustrates an example pulse power drilling system 100, including a pulse power drilling assembly (hereinafter "assembly") 150 positioned in a borehole 106 and secured to a length of drill pipe 102 coupled to a drilling platform 160 and a derrick 164. The assembly 150 is configured to further the advancement of the borehole 106 using pulses of electrical power generated by the assembly 150 and provided to electrodes 144 in a controlled manner to break up or otherwise fracture formation material of a subsurface formation along the bottom face of the borehole 106 and in the nearby proximity to the electrodes 144.

A flow of a drilling fluid 110A within the drill pipe 102 is provided from the drilling platform 160 and flows to and through a turbine 116, exiting the turbine 116 and flowing into other sub-sections or components of the assembly 150. The flow of the drilling fluid 110A through the turbine 116 causes the turbine 116 to mechanically rotate. This mechanical rotation is coupled to an alternator 118 sub-section or component of the assembly to generate electrical power. The alternator 118 can further process and controllably provide electrical power to the rest of the assembly 150. The power output is stored as electrical energy within charge storage components such as a bank of primary capacitors 136 and a bank of secondary capacitors 142. The stored energy can then be applied to and output from the electrodes 144 as periodic electrical discharges to drill the borehole 106.

The drilling fluid flows through assembly 150, as indicated by arrow 110B, and flows out and away from electrodes 144 and back toward the surface to aid in the removal of the debris generated by the breaking up of the formation material at and nearby electrodes 144. The fluid flow direction away from electrodes 144 is indicated by arrows 110C and 110D. In addition, the flow of drilling fluid may provide cooling to one or more devices and to one or more portions of assembly 150. In various embodiments, it is not necessary for assembly 150 to be rotated as part of the drilling process, but some degree of rotation or oscillations of assembly 150 may be provided in various embodiments of drilling processes utilizing assembly 150, including internal rotations occurring at the turbine 116, in the alternator 118 sub-section, etc.

As illustrated in FIG. 1, the assembly 150 includes multiple sub-assemblies, including in some embodiments the turbine 116 at the top of the assembly 150 where the top is a face of the assembly 150 furthest from a drilling face of the assembly 150 that contains the electrodes 144. The turbine 116 may be coupled to multiple components including the alternator 118, a rectifier 120, a rectifier controller 122, a direct current (DC) link 124, a DC-to-DC booster 126, a generator controller 128, a pulse power controller 130, a switch bank 134 that includes one or more switches 138, one or more primary capacitors 136, a transformer 140, one or more secondary capacitors 142, and the electrodes 144.

The assembly 150 can be divided into a generator 152 and a pulse power section 154. The generator 152 may include the turbine 116, the alternator 118, the rectifier 120, the rectifier controller 122, the DC link 124, the DC-to-DC booster 126, and the generator controller 128. The pulse power section 154 may include the pulse power controller 130, the switch bank 134, the primary capacitors 136, the transformer 140, the secondary capacitors 142, and the electrodes 144. Components can be divided between the generator 152 and the pulse power section 154 in other arrangements, and the order of the components can be other than as shown. The assembly 150 may comprise multiple sub-sections, with a joint used to couple each of the sub-sections together in a desired arrangement. Field joints 112A-C can be used to couple the generator 152 and the pulse power section 154 to construct the assembly 150 and to couple the assembly 150 to the drill pipe 102. Embodiments of the assembly 150 may include one or more additional field joints coupling various components of the assembly 150.

The drilling fluid 110A passing through the turbine 116 continues to flow through one or more sections of a center flow tubing 114 that provides a flow path through one or more components of the assembly 150. The portion of the flow is depicted as drilling fluid 110B positioned between the turbine 116 and the electrodes 144, as indicated by the arrow pointing downward through the cavity of the center flow tubing 114. Once arriving at a drill head on which electrodes 144 are mounted, the flow of drilling fluid is expelled out from one or more ports or nozzles located in or in proximity to the drill head. After being expelled from the assembly 150, the drilling fluid flows back upward toward the surface through an annulus 108 created between the assembly 150 and the walls of the borehole 106.

The system 100 may include one or more logging tools 148. The one or more logging tools 148 are shown as being located on the drill pipe 102, above the assembly 150, but may also be included within the assembly 150 or joined via a shop joint or a field joint to the assembly 150. Logging tools 148 may include one or more logging while drilling (LWD) or measurement while drilling (MWD) tools, including resistivity, gamma-ray, nuclear magnetic resonance (NMR), etc. The system 100 may also include directional control, such as for geosteering or directional drilling, which can be part of the assembly 150, the logging tools 148, or located elsewhere on the drill pipe 102.

Communication from a pulse power controller 130 to the generator controller 128 allows the pulse power controller 130 to transmit data about and modifications for pulse power drilling to generator 152. Similarly, communication from the generator controller 128 to pulse power controller 130 allows the generator 152 to transmit data about and modifications for pulse power drilling to the pulse power section 154. The pulse power controller 130 is configured to control the discharge of the stored pulse energy stored for emissions out from the electrodes 144 and into the formation, into drilling mud, or into a combination of formation and drilling fluids. Pulse power controller 130 can measure data about the electrical characteristics of each of the electrical discharges—such as power, current, energy, and voltage emitted by the electrodes 144. Based on information measured for each discharge, the pulse power controller 130 can determine information about drilling and about the electrodes 144, including whether the electrodes 144 are firing into the formation (i.e., drilling) or firing into the formation fluid (i.e., electrodes 144 are off bottom). The generator 152 can control the charge rate and charge voltage for each of the multiple pulse power electrical discharges. Generator 152, together with turbine 116 and alternator 118, can create an electrical charge in the range of 16 kilovolts (kV) which the pulse power controller 130 delivers to the formation via the electrodes 144.

In response to communication from the pulse power controller 130, encoded and transmitted as described herein, the generator 152 may modify charging metrics such as charge rate and charge amplitude based on electrical discharge characteristics and changes thereto detected at the pulse power controller 130. Because the load on the turbine 116, the alternator 118, the generator 152, and the electrodes 144 is large, modifying the charging metrics in response to the communicated instructions from the pulse power controller 130 may protect the generator 152 and associated components from load stress and can extend the lifetime of components of the pulse power drilling assembly. Modulating the charging metrics in this manner may also enable more efficient drilling operation, for example, in terms of optimizing necessary breakdown voltages during drilling in a variable parameter environment (e.g., changing temperature, differing lithology properties, etc.).

For instances in which the assembly 150 is off bottom, electrical power input to the system may be at least partially absorbed by the drilling fluid, which can be vaporized, boiled off, or destroyed because of the large power load transmitted in the electrical pulses. In these and additional cases, communications or messages between the pulse power controller 130 and the generator 152 allow the entire assembly to vary charge rates and voltages, along with other adjustments depicted and described herein. Especially where pulse power controller 130 and generator 152 are autonomous, i.e., not readily in communication with the surface, downhole control of the assembly 150 can improve pulse power drilling function.

Figure 2:
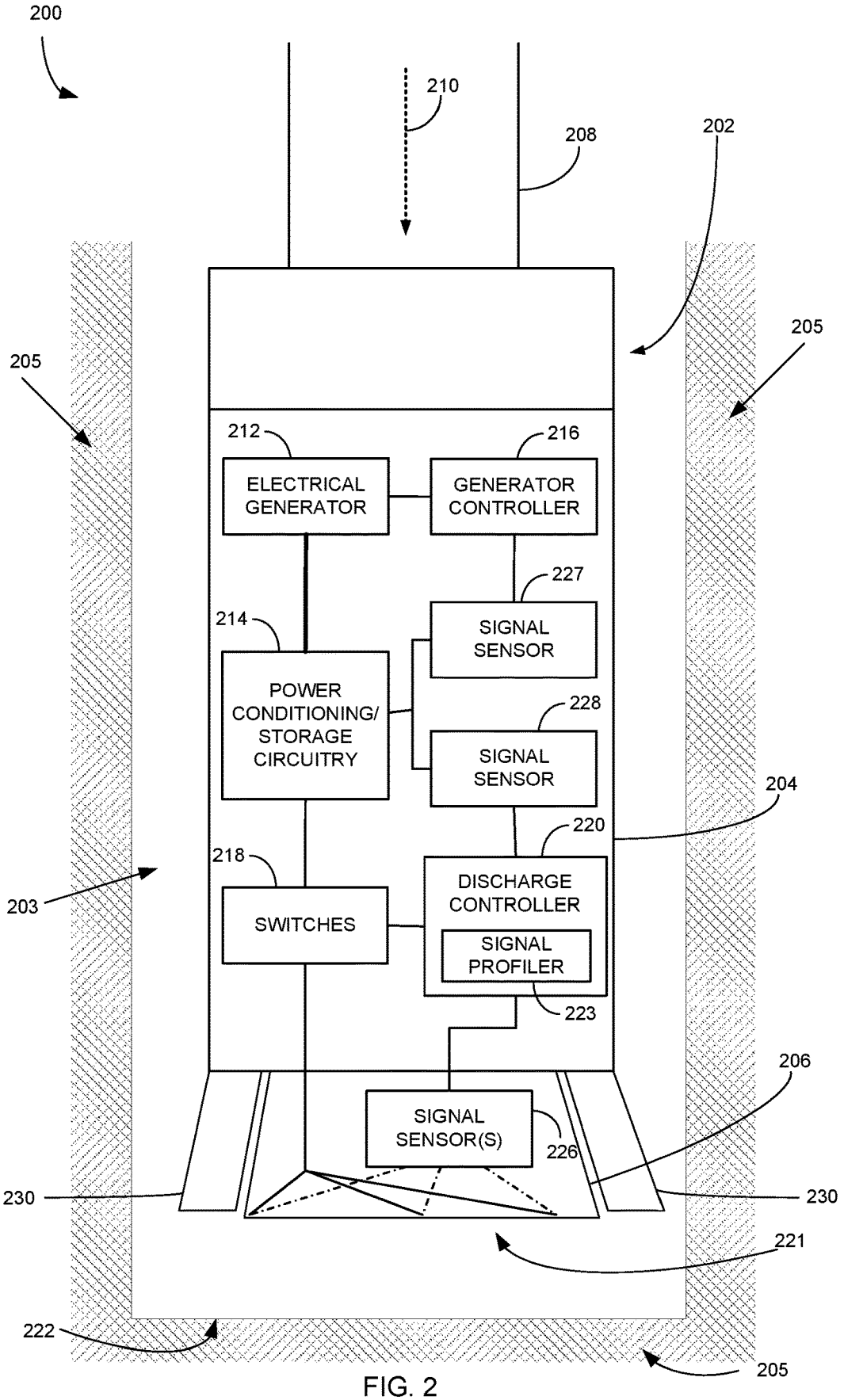
FIG. 2 is a block diagram illustrating a lower end of a drill string that includes a pulse power drilling assembly, according to various embodiments.

FIG. 2 is a block diagram illustrating a lower end of a drill string 200 that includes a pulse power drilling assembly ("assembly") 202, according to various embodiments. The systems and components depicted in FIG. 2 may be implemented in the pulse power drilling system shown in FIG. 1. As shown in FIG. 2, the lower end of the drill string 200 includes assembly 202 coupled to a section of drill pipe 208 and disposed in proximity to a bottom surface 222 of a borehole 203 extending into formation 205. Assembly 202 includes a pulse power section 204 and an electrode assembly 206 that are cooperatively configured to generate and to discharge, respectively, a series of electric discharges provided proximate to or at the bottom surface 222 during various pulse power drilling operations.

Pulse power section 204 includes components configured to generate, condition, store, and controllably provide electrical energy, in various embodiments in the form of the electric pulses, to one or more electrodes on an electrode face 221 of the electrode assembly 206. The electrical energy provided by to the electrode(s) of the electrode assembly 206 may be emitted from the electrode(s) and into the formation 205 in the area proximate to bottom surface 222 in order to advance borehole 203 further into the formation 205 as part of a pulse power drilling operation. The electrode assembly 206 may be surrounded by a ground ring 230. The ground ring 230 may be electrically coupled to the tool body of the assembly 202 to provide a return path for the electrical discharges emitted by the electrode(s).

Embodiments of pulse power section 204 may include an electrical generator 212 that is coupled with power conditioning and storage circuitry 214. In various embodiments, electrical generator 212 includes a turbine and alternator arrangement configured to utilize the flow of drilling fluid 210 provided to assembly 202 through drill pipe 208 to generate an output of electrical power. Embodiments of electrical generator 212 may include one or more additional components and/or additional circuitry, such as rectifiers, electrical filtering circuitry, and voltage step-up circuitry, configured to further condition and/or modify one or more parameters of the electrical power being provided as an output from the electrical generator 212. In various embodiments, electrical generator 212 may be configured similarly or the same as generator 152 in FIG. 1 and in various embodiments may include a turbine, an alternator, and rectifier components for generating electrical energy, and may be configured to perform any of the functions and to provide any of the features described above with respect to generator 152. For embodiments in which electrical energy is generated in situ via a turbine, the flow of drilling fluid 210 drives the turbine which in turn actuates rotation in the alternator. Integrated with or otherwise coupled with electrical generator 212 is a generator controller 216. Generator controller 216 may be configured using any combination of electronic components, processor hardware, and program code for controlling operation of the components within electrical generator 212. For example, generator controller 216 may include a microprocessor and storage media such as memory in which instructions are encoded and executed by the microprocessor to implement the operations described in the depicted embodiments.

In alternative embodiments, electrical power for use in pulse power drilling operations may be supplied to the assembly 202 from the surface, via one or more wires or via wired pipe. In these embodiments, assembly 202 may not include the electrical generator 212, but instead may have the electrical power provided from the surface coupled to the power conditioning and storage circuitry 214.

For each pulse, the charge/energy generated by electrical generator 212 is stored by the power conditioning and storage circuitry 214. To effectuate a pulse discharge, the stored charge is released by operation of a set of switches 218 as determined by a discharge controller 220. When actuated (e.g., closed), the switches 218 apply the stored charge voltage to the electrode(s) on the electrode face 221 of the electrode assembly 206. In some embodiments, discharge controller 220 may include or be incorporated as part of pulse power controller 130 depicted in FIG. 1. Referring again to FIG. 2, discharge controller 220 may be configured using any combination of electronic components, processor hardware, and program code for controlling the discharge timing for each of the sequence pulses enabling a controlled sequence of discharges from the electrodes. For example, discharge controller 220 may include a microprocessor and storage media such as memory in which instructions are encoded and executed by the microprocessor to implement the operations described in the depicted embodiments.

During active drilling and/or between active drilling cycles it may be useful to regulate pulse generation metrics such as pulse discharge rate and amplitude of the pulses. Unnecessary energy consumption and tool wear may occur during periods in which assembly 202 is lifted from bottom surface 222 and the portion of each discharged pulse that is expended as arcing is substantially reduced. For example, assembly 202 may be slightly or moderately lifted during routine drill operation cycling or based on downhole conditions such as debris buildup. Regulation of the pulse generation metrics may also be useful for optimizing drilling efficiency in terms of rate of penetration, for example.

The depicted assembly 202 further includes components within the pulse power section 204 and electrode assembly 206 configured to modulate or otherwise control generating and discharging of pulses during downhole operations. In some embodiments, the signal profiles for pulse discharges are detected and analyzed to determine arcing characteristics indicative of a pulse in which a plasma arc was or was not formed. Based on the arc characteristic of a pulse signal, a pulse power metric, such as pulse rate and or pulse amplitude, may be adjusted by the pulse power section 204.

The electrode assembly 206 includes a set of signal sensors 226 configured to detect pulse discharges from the electrode(s) on the electrode face 221. Signal sensors 226 may comprise voltage sensors and/or current sensors disposed within the electrode assembly 206 or pulse power section 204 and coupled with the electrode(s). Signal sensors 226 are configured to detect pulse signals, and/or to measure one or more parameters associated with the pulse signals. The pulse signal information detected by signal sensors 226 may be processed internally or externally to the sensors by one or more signal processors that translate or otherwise condition the measured voltage/current signal into digital information that may be programmatically processed.

The signal information corresponding to the monitored pulses is provided to a pulse signal profiler 223 that may be incorporated within discharge controller 220 or otherwise communicatively coupled therewith. Signal profiler 223 may be configured using any combination of program code and data to determine arc characteristics of the detected pulse signals. The arc characteristics indicate whether and/or to what extent a given pulse discharge successfully achieved dielectric breakdown, generating a substantial plasma arc between electrodes. In some embodiments, signal profiler 223 is configured to determine an arc characteristic of a pulse signal by determining an amount or proportion of the pulse signal that was transferred between electrodes that is indicative of a substantial plasma arc.

In some embodiments, signal profiler 223 determines the pulse energy transfer by analyzing peak amplitudes at various points within a pulse signal. In some embodiments, signal profiler 223 may classify a pulse signal as indicating absence of a substantial arc in response to determining that the amplitude of pulse portion is less than the threshold value. Additionally or in the alternative, signal profiler 223 may classify a pulse signal based on amplitude analysis of a settling portion of the waveform of the pulse. Ringing is a phenomenon in which a pulse or other abrupt signal results in subsequent oscillation noise that may have a significant amplitude when a pulse discharge fails to achieve arcing. For embodiments in which measurement of ringing is utilized to classify a pulse signal, signal profiler 223 may be configured to detect ringing based on the amplitudes of the signal during the settling portion of the signal. For example, signal profiler 223 may apply a specified peak-to-peak amplitude threshold to the setting portion of a pulse signal to classify as indicating a substantial arc or lack of arcing.

In some embodiments, signal profiler 223 is configured to detect, measure, or otherwise determine the proportion of a pulse signal that is transferred from the electrodes and returned to the ground ring 230 (i.e., determine arcing or lack thereof) by using pattern matching. For example, signal profiler 223 may include or have access to a library of pulse signal shapes corresponding to various levels of arcing and lack of arcing. Signal profiler 223 may apply a pattern matching algorithm to determine a pattern match between a detected pulse and a signal shape profile that indicates an arc or lack of arcing.

Having determined an arc characteristic (e.g., arc, no arc, proportion/percent arc, etc.) of a pulse signal, the pulse power section 204 may be further configured to control further pulse power operations accordingly. The depicted assembly includes additional systems and components configured to determine whether and in what manner to modify pulse power operations, including aspects of power conditioning. Regardless of the manner of arc characterization, discharge controller 220 is configured to determine whether and in what manner to modify pulse power operations based on the characterization or a set of characterizations determined over multiple pulse discharges. In some embodiments, discharge controller 220 includes coded instructions and data configured to select pulse modification instructions based on the arc characterization(s). The assembly further includes systems and components configured to provide communication such as between discharge controller 220 and generator controller 216 to implement pulsing operation and/or modifications to pulsing operations by leveraging pulse generation and discharge infrastructure.

In some embodiments, the assembly 202 includes a communication channel between discharge controller 220 and generator controller 216 using sensed voltage levels into or on capacitor included within power conditioning and storage circuitry ("circuitry") 214. To this end, pulse power section 204 includes signal sensors 227 and 228, each configured to sense voltage or current levels into or on capacitor of circuitry 214. While signal sensors 227 and 228 may be implemented as distinct, physically separate components, they may be combined as a single or otherwise unified a single sensor in alternate embodiments. As depicted, signal sensor 227 is communicatively connected to and provides the voltage/current values detected for the circuitry 214 to generator controller 216. Signal sensor 228 is communicatively connected to and provides the voltage/current values detected for the power conditioning and storage circuitry 214 to discharge controller 220. In this manner, generator controller 216 and discharge controller 220 simultaneously receive instantaneous voltage/current information that effectively communicates the state of pulse power drilling operations at any instant in time.

Figure 3B:
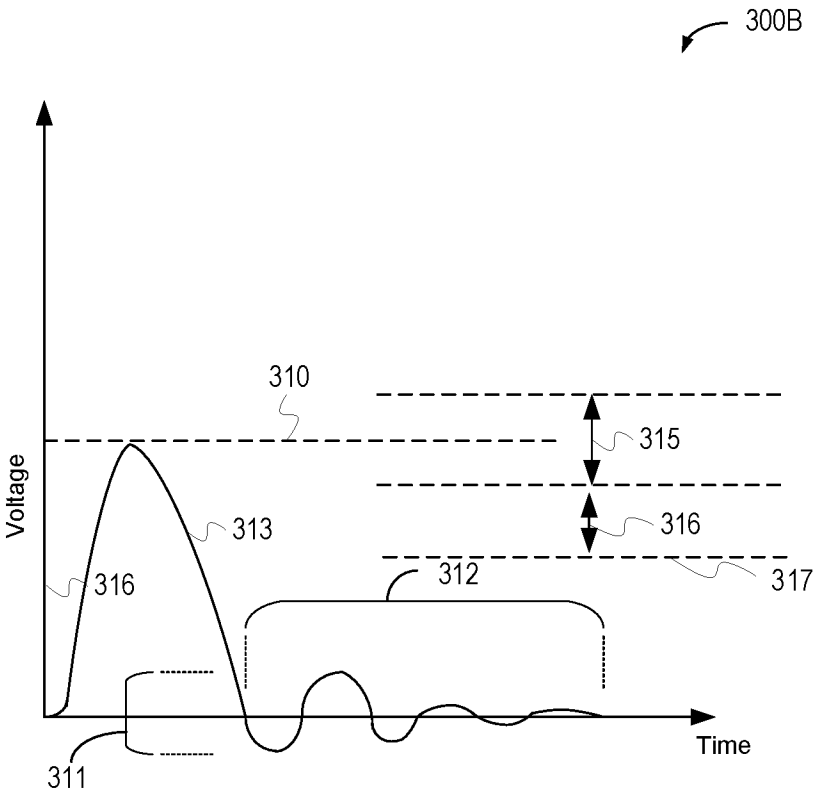
FIG. 3B illustrates a graph of an example of measurements of parameters used to determine changes in formation material during advancement of a borehole in a first zone of formation material using a pulse power assembly, according to various embodiments.
Figure 3A:
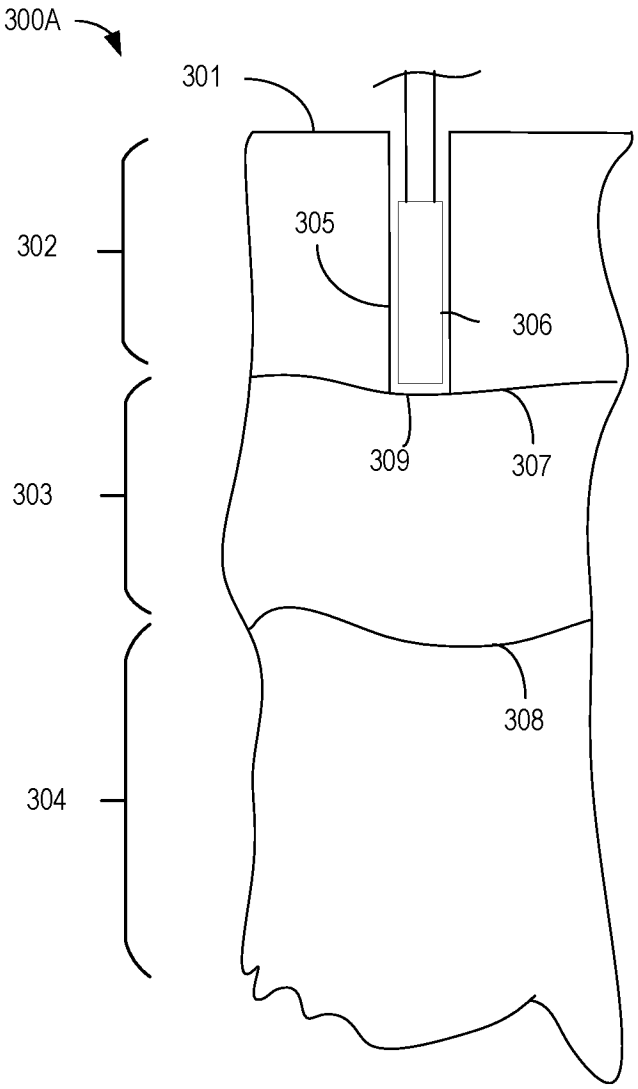
FIG. 3A illustrates a system including a pulse power drilling assembly positioned within a borehole extending into a formation, according to various embodiments.

FIG. 3A illustrates a system 330A including a pulse power drilling assembly 306 positioned within a borehole 305 extending into a formation, according to various embodiments. As shown in FIG. 3A, the formation comprises various zones of formation material. A first zone of formation material 302 extends from surface 301 to transitional area 307. A second zone of formation material 303 lies below the first zone of formation material 302 and extends from transitional area 307 to transitional area 308. A third zone of formation material 304 lies below the second zone of formation material 303 and extends downward from transitional area 308. As shown in FIG. 3A, a borehole 305 extends from surface 301 through the first zone of formational material 302, having a bottom surface 309 of the borehole at or proximate to and above transitional area 307. In various embodiments, system 300A includes a formation broken into the different zones of formational material based on the type or classification of the material forming the layer in each respective zone. In various embodiments, system 300A includes a formation broken into different zones based on the composition of the material included within the respective zone. For example, the presence of oil or other hydrocarbons and/or the presence of water within a layer of the formation may determine that layer to be classified as a different zone relative to other layer of the foundation positioned above, below, or adjacent to the layer containing the additional fluids or material. In various embodiments, each zone of formation material 302-304 may be determined based on a difference in formation material relative to the formation material of one or more adjacent zones. The zones of formation material 302-304 as shown in FIG. 3A are for illustrative purposes only. A formation may contain more or fewer zones than depicted in FIG. 3A, and the zones may vary in size, shape, and/or length from those depicted in FIG. 3A.

As shown in FIG. 3A, assembly 306 is illustrated as positioned at the bottom surface 309 of the borehole 305 and within the first zone of formation material 302. In various embodiments, assembly 306 may be the same or similar to assembly 150 as illustrated and described above with respect to FIG. 1, and/or may be similar to or the same as assembly 202 as illustrated and described above with respect to FIG. 2. Referring again to FIG. 3A, assembly 306 includes one or more electrodes (not shown) positioned at the bottom of the assembly 306 and configured to deliver electrical energy emitted by the one or more electrodes into the formation in order to break up and/or vaporize the formation material in proximity to the electrodes in order to advance the borehole 305. Assembly 306 may be configured to provide a series of electrical pulses to the electrodes, and thus to the formation material proximate the electrodes, in order to advance the bottom surface 309 of the borehole 305 through the formation. For one or more or for all of these electrical pulses provided to the electrodes, one or more electrical parameters associated with the respective pulses may be monitored using one or more sensors (not shown in FIG. 3A, but for example sensors 226, FIG. 2), and signals provided by the one or more sensors indicative of the monitored electrical parameter may be provided to a controller (not shown in FIG. 3A, but for example discharge controller 220, FIG. 2) for analysis. The analysis of these monitored electrical parameter may be used to determine in some embodiments that the electrodes of the assembly 306 are still positioned within formation material classified as belonging to the first zone of formational material 302. The analysis of these monitored electrical parameters may be used to determine in some embodiments that the electrodes of the assembly 306 have reached transitional zone 307 and have extended borehole 305 into foundation material classified as belonging to the second zone of formation material 304.

Because the analysis of the parameters associated with electrical pulses emitted by the electrodes can be performed in real-time, the results of the analysis can indicate the conditions at the current location of the electrodes, and thus at the bottom of the borehole 305 also in real time. This capability provides advantages over existing drilling systems that for example use mechanical drill bits to advance the borehole, and sensors and associated analysis techniques, such as drilling mud analysis, that only allow for the results of the analysis to be available after the drilling operation has progressed and the bottom of the borehole is for example several feet past the point where the data associated with the foundation material is now available. In some instances, the delay in the availability of data related to the formation material may result in the inability to stop the drilling operation, for example, before the borehole crosses a transitional zone and enters into a layer of the formation that is not desirable to have the borehole extended into. For example and with respect to FIG. 3A, if it is known that the second zone of formation material 304 contains water, and that it is undesirable to extend borehole 305 into the second zone of formation material 303, knowing that borehole 305 has reached transitional zone 307 in real time, and to therefore to stop the drilling operations within borehole 305, may be a valuable tool in providing a desired outcome for forming the borehole. In the alternative, it may be unknown that the second zone of formation material 304 comprises an undesirable characteristic, such as the presence of water. However, by being able to provide real-time analysis for the drilling operation, once borehole 305 extends through transitional zone 307 and into the second zone of formational material, the presence of the undesirable characteristic can be determined, and therefore drilling stopped in order to minimize the extension of the borehole into the area of the formation having the undesirable characteristic(s). This may allow for a more effective means to seal off the portion of the borehole extending into the undesirable formation material as opposed to the extent of intrusion into the undesired layer of formation material that may result for other methods of monitoring drilling operations.

In another example, it may be known that the second zone of formation material 303 includes a desirable characteristic, such as the presence of an oil reserve, and therefore in order to maximize the benefit of borehole 305 is may be desirable to begin a turning of the direction of the borehole once the borehole extends into the second zone of formation material 303, for example in a non-vertical or horizontal direction, in order to maximize the extension of the borehole 305 within the second zone of formation material 303. Thus, knowing when the borehole has been extended to pass through the transitional layer 307 in real-time may be a valuable tool in providing a desired outcome for forming the borehole 305.

While the assembly 306 is advancing the borehole 305 through the first zone of formation material 302, and during the initial application of a voltage pulse by the assembly 306, the formation material in the first zone of formation material 302 initially acts as a high resistance dielectric material. Upon the electrical pulse reaching a peak voltage level, the dielectric property of the formation material breaks down, and electrical potential provided to electrode(s) of the assembly 306 generates electrical current that passes through the formation material and to ground ring(s) of the assembly 306. Upon reaching a breakdown voltage, the voltage level drops back toward the initial voltage level, where a series of voltage oscillations, or "ringing" may occur. The time period over which these oscillations occur ("ring period") and maximum peak or maximum peak-to-peak amplitude of these oscillations may be parameters that are measured and used to determine whether the borehole has remained in a same type of formation material or has advanced through a first type of formation material, such as the first zone of formation material 302, and moved into a different formation material, such as the second zone of formation material 303.

Measured parameters associated with the application of pulsed electrical power to the formation material is not limited to voltage measurements, or to any particular single parameter or sets of parameters. Other measured parameters, such as current measurements, energy (joule) measurements, and/or power (wattage) measurements, ring periods, and/or phase shifts between voltages, current, and/or voltages and currents may be made, and the measured parameters, or one or more other parameters derived from the measured parameters, may be used to determine when the borehole has been advanced out of one type of formation material and into a different type of formation material.

FIG. 3B illustrates a graph 300B of an example of measurements of parameters used to determine changes in formation material during advancement of a borehole in a first zone of formation material using a pulse power assembly, according to various embodiments. The graph 300B represents a typical voltage waveform that might occur for a pulse of electrical energy applied by the assembly, such as assembly 306 of FIG. 3A, while the borehole is being extended through the corresponding first zone 302 of the formation material. The graph 300B is a graph of voltage (y-axis) vs. time (x-axis). As shown in graph 300B, a voltage waveform 313 having a peak voltage level 310 as a maximum voltage level for the waveform 313 may be measured for an electrical pulse applied to the formation material while the assembly is advancing the borehole through the first zone formation material. For example, the voltage waveform represented by graph 300B may be a typical waveform, with variations within given percentages or tolerance amounts, for the electrical pulses generated by the assembly as the assembly moves through the first zone formation material.

After of discharge of a pulse of electrical energy from the electrodes of the pulse power assembly, the voltage of the waveform 313 increases until the electrical pulse reaches the peak voltage 310. Upon the electrical pulse reaching the peak voltage level 310, the dielectric property of the formation material breaks down. Upon reaching a peak voltage 310, which can also be called a breakdown voltage, the voltage level drops back toward the initial voltage level, where a series of voltage oscillations, or ringing may occur. The ring-period 312 and ring amplitude 311 of the waveform 313 indicate the time period the ringing occurs as well as the maximum peak or maximum peak-to-peak amplitude of these oscillations, respectively. The peak voltage 310, ring period 312, and ring amplitude 311 may be parameters that are measured and used to determine whether the borehole has remained in a same type of formation material or has advanced through a first type of formation material, such as the first zone 302 formation material, and moved into a different formation material, such as the formation material of the second zone 303.

To determine whether the assembly has advanced the borehole through a first type of formation material into a second type of formation material, multiple waveforms corresponding to a series of electrical pulse discharges are compared. In some instances, there may be a drastic change between waveforms, for instance when there is a defined boundary between two formation types, and the formation types are not similar. In these instances, the determination that the borehole has advanced into a new formation type may be determined based on step up between two measured waveforms. By comparing trends of measurements throughout the drilling process, a formation zone advancement determination can be made. The number of waveforms used in the comparison may be based on a set number of pulse discharges, a time of drilling operations, a distance of advancement of the borehole, or other drilling variables. For example, a set number of ten pulse discharges may be used for the determination of advancement of the borehole, with the pulse discharge corresponding to waveform 313 being used as the first pulse discharge and four subsequent discharges having waveforms all falling with the range 315. The five subsequent discharges may all have waveforms with voltages corresponding to a voltage at or below voltage 317, where the voltage 317 is beyond a statistical variation of the range 315. By analyzing the trends of all ten waveforms, it can be recognized that a significant change in the peak voltage of the waveform occurred, which can be correlated to a change in formation type. The voltage range 315 and the voltage 317 may be predetermined values based on prior knowledge of formation type properties. Alternatively, a statistical variation, such as a percentage, may be defined to determine the ranges, for example, a variation of greater than 5% between peak voltages of adjacent waveforms.

In some instances, there may not be a defined boundary between two formation types. Instead, the formation may gradually transition between two formation types as the borehole advances through a transition zone, such as transitional area 307 of FIG. 3A, represented by range 316 in graph 300B of FIG. 3B. When the formation types gradually transition from one type to another, where there may be a mix of formation types in the transition area, the waveforms of subsequent discharges may gradually decrease with peak voltages throughout the range 316 before reaching peak voltages at or below voltage 317. In this instance, trends of subsequent discharges may be analyzed to determine a relative leveling off of the peak voltages, which will indicate advancement from the transitional area into the second zone of formation material.

Due to the natural variation of measurements of different pulses, waveforms may vary within a given zone of formation material. Waveforms may be impacted by properties of the pulses, such as variations in the power output from the power conditioning circuitry, or waveforms may be impacted by inconsistencies within the formation material which cause anomalies in the measurements. For example, small pockets of gas and/or fluids within the formation material may cause a waveform of one measurement to vary uncharacteristically from the surrounding waveforms. These anomalies may cause outliers in the data which can be ignored or removed when analyzing the trends. For example, standard deviation analysis may be used to determine outliers where measurements outside of a set standard deviation are not used.

Figure 4B:
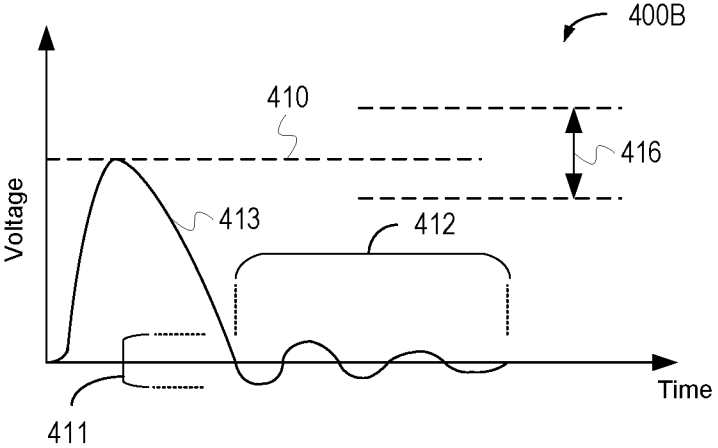
FIG. 4B illustrates a graph of an example of measurements of parameters used to determine changes in formation material during advancement of a borehole into a second zone of formation material using a pulse power assembly, according to various embodiments.
Figure 4A:
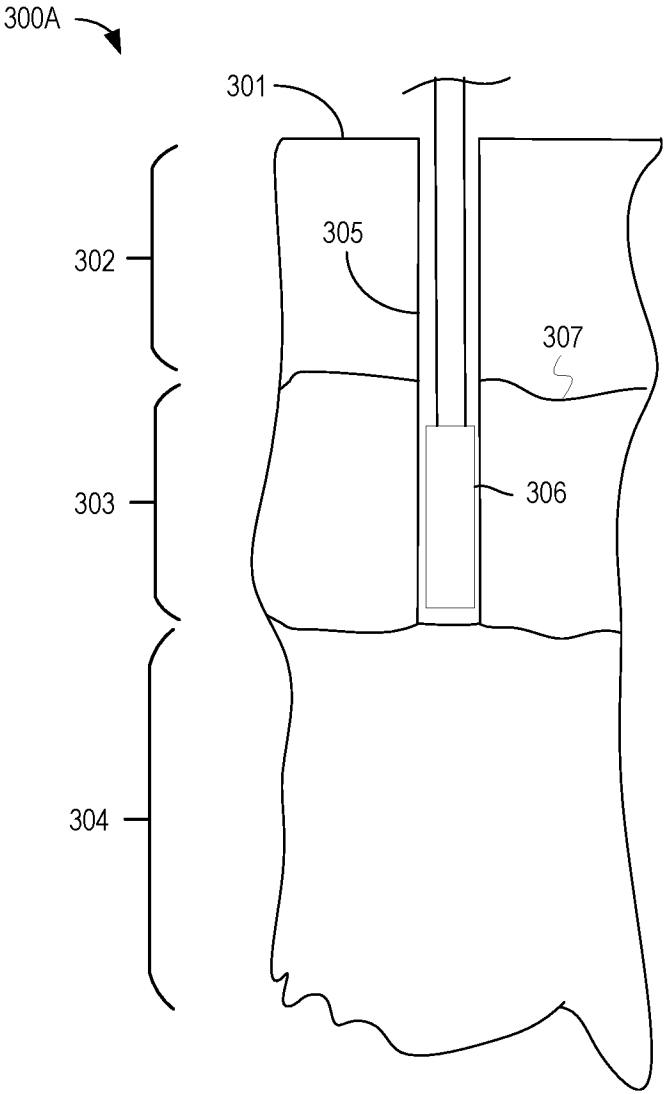
FIG. 4A illustrates the system of FIG. 3A including the assembly positioned within the borehole, which has been extended from the surface through first zone of formation material and into a second zone of formation material, according to various embodiments.

FIG. 4A illustrates system 300A of FIG. 3A including assembly 306 positioned within borehole 305, which has been extended from surface 301 through first zone of formation material 302 and into second zone of formation material 303, according to various embodiments. In various embodiments, FIG. 4A depicts a continuation of FIG. 3A in which pulse power drilling operations of the assembly 306 have extended the borehole 305 through the first zone of formation material 302 and into the second zone 303. By extending the borehole 305 out of first zone of formation material 302 and into second zone of formation material 303, the assembly 306 advanced borehole 305 across the transitional zone 307. The transitional zone 307 is a region characterized by a transition of formation materials from the formation materials of the first zone of formation material 302 into the second zone of formation materials 303. The transitional zone 307 may be a distinct boundary at a set distance from the surface 301, or the transitional zone 307 may be a transition area. The transition area may be a mix of formation materials including the formation materials of both the first zone and the second zone. The transition area may be on the scale of centimeters to tens of meters in depth. Extending the borehole 305 from the first zone of formation material 302 to the second zone of formation material 303 may result in a change in the measured parameters, an example of which is shown in FIG. 4B.

FIG. 4B illustrates a graph 400B of an example of measurements of parameters used to determine changes in formation material during advancement of a borehole into a second zone of formation material using a pulse power assembly, according to various embodiments. The graph 400B represents a typical voltage waveform that might occur for a pulse of electrical energy applied by the assembly, such as assembly 306 of FIG. 4A, while the borehole is being extended through the corresponding second zone of formation material 303. The graph 400B is a graph of voltage (y-axis) vs. time (x-axis). As shown in graph 400B, a voltage waveform 413 having a peak voltage level 410 as a maximum voltage level for the waveform 413 may be measured for an electrical pulse applied to the formation material while the assembly is advancing the borehole through the second zone formation material 303. With reference to graph 300B of FIG. 3B, the range 416 may be similar to the range 316. As the assembly advances the borehole into the second zone of formation material 303, the typical waveform generated by the application of the electrical pulses applied to the formation material may become like the waveform 413. In the graph 400B, the maximum voltage level of the peak voltage 410 where the dielectric property of the second zone of formation material 303 breaks down may be a lower voltage level compared to the peak voltage 310 presented in the graph 300B of FIG. 3B. In addition, an overall ring period 412 and/or the maximum peak or maximum peak-to-peak ring amplitude 411 of the voltage waveforms generated in the formation material of the second zone 403, as shown in graph 400B, may be less or smaller than these same parameter values associated with the voltage waveform 313 depicted in graph 300B of FIG. 3B. These differences may be used to determine that the assembly has moved from the first zone of formation material 302 to the second zone of formation material 303 in the process of advancing the borehole 305.

Figure 5B:
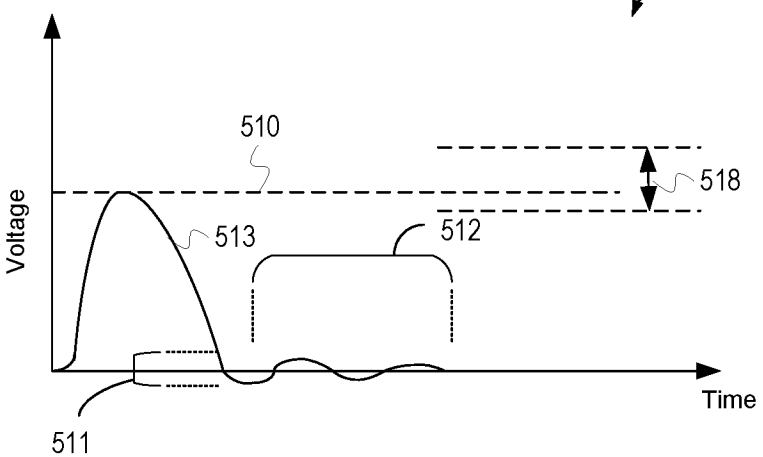
FIG. 5B illustrates a graph of an example of measurements of parameters used to determine changes in formation material during advancement of a borehole into a third zone of formation material using a pulse power assembly, according to various embodiments.
Figure 5A:
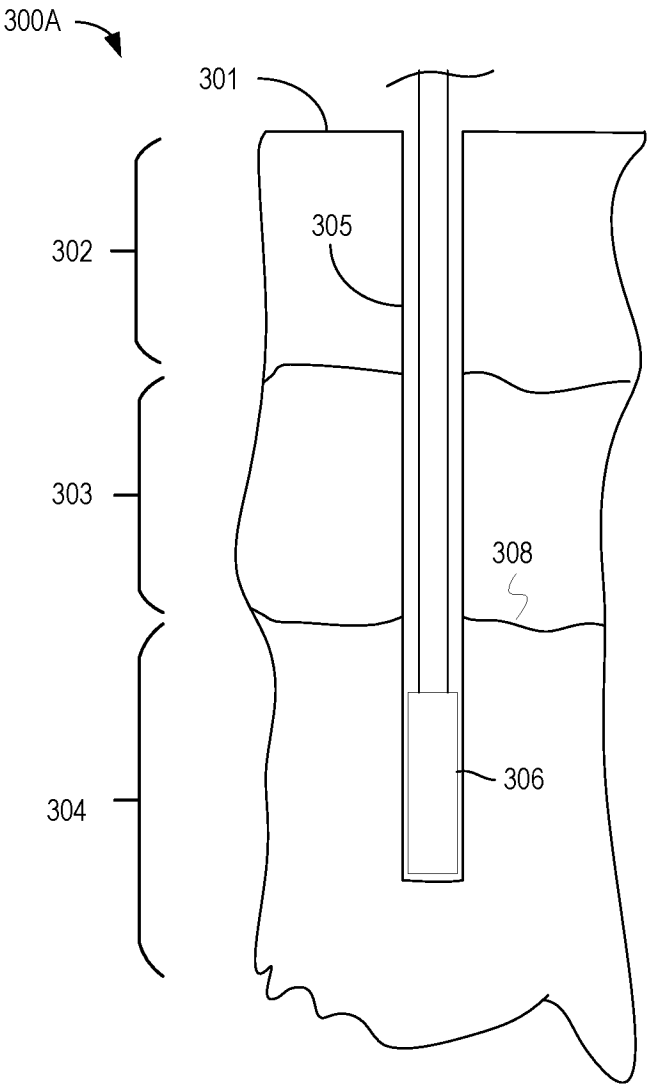
FIG. 5A illustrates the system of FIGS. 3A and 3B, including the assembly positioned within the borehole, which in FIG. 5A has been extended from the surface through the first zone of formation material, through the second zone of formation material, and into a third zone of formation material, according to various embodiments.

FIG. 5A illustrates system 300A of FIGS. 3A and 3B, including assembly 306 positioned within borehole 305, which in FIG. 5A has been extended from surface 301 through first zone of formation material 302, through second zone of formation material 303, and into third zone of formation material 304, according to various embodiments. FIG. 5A depicts a continuation of FIG. 4A in which operation of the assembly 506 has extended the borehole 305 from the second zone of formation material 303 and into the third zone of formation material 304. By extending the borehole 305 past the boundaries of the first zone of formation material 302 and the second zone of formation material 303 into the third zone of formation material 304, the assembly 306 crossed the second transitional area 308 between the second zone of formation material 303 and the third zone of formation material 304. The transitional area 308 is a region in which formation materials transition from the formation materials of the second zone into the formation materials of the third zone. The transitional area 308 may be a distinct boundary at a set distance from the surface 301, or the transitional area 308 may be a transition area with a mix of formation materials including the formation materials of both the second and third zone. The transition area may be on the scale of centimeters to tens of meters in depth. Extending the borehole 305 from the second of formation material 303 to the third zone of formation material 304 results in a change in the measured parameters, an example of which is shown in FIG. 5B.

FIG. 5B illustrates a graph 500B of an example of measurements of parameters used to determine changes in formation material during advancement of a borehole into a third zone of formation material using a pulse power assembly, according to various embodiments. The graph 500B represents a typical voltage waveform that might occur for a pulse of electrical energy applied by the assembly, such as assembly 306 of FIG. 5A, while the borehole is being extended through the corresponding third zone of formation material 304. The graph 500B is a graph of voltage (y-axis) vs. time (x-axis). As shown in graph 500B, a voltage waveform 513 having a peak voltage level 510 as a maximum voltage level for the waveform 513 may be measured for an electrical pulse applied to the formation material while the assembly is advancing the borehole through the third zone formation material. In the graph 500B, the peak voltage level 510, where the dielectric property of the third zone formation material breaks down, may be a lower voltage level compared to the peak voltage level 410 presented in the graph 400B of FIG. 4B. The range 518 may be a range of voltage values associated with measurements corresponding to the third zone of formation material 304. The upper and lower limits of the range 518 may be predetermined based on values obtained from a data table or geological survey, or the values may be adaptively determined during pulse power drilling operations. For example, the range may be determined based on a percent difference from a voltage measurement of a first discharge of the electrodes during pulse power drilling operations. In addition, the overall ring period 512 and/or the maximum peak or maximum peak-to-peak ring amplitude 511 of the voltage waveform 513 generated in the third zone of formation material, as shown in the graph 500B, may be less or smaller than these same parameter values associated with the voltage waveform 313 depicted in graph 300B of FIG. 3B and waveform 413 depicted in the graph 400B of FIG. 4B. These differences may be used to determine that the assembly has moved from the second zone of formation material to the third zone of formation material in the process of advancing the borehole.

Again with respect to the representation of voltages in FIGS. 4B and 5B, measured and/or calculated parameters associated with the electrical pulses are not limited to voltage measurements, and may include any measured parameters associated with the application of pulsed electrical power to the formation material including but not limited to voltage measurements, or to any particular single parameter or sets of parameters. As described above with respect to FIG. 3B, other measured parameters, such as current measurements, energy (joule) measurements, and/or power (wattage) measurements, ring periods, and/or phase shifts between voltages, current, and/or voltages and currents may be made, and the measured parameters, or one or more other parameters derived from the measured parameters, may be used to determine when the borehole has been advanced out of one type of formation material and into a different type of formation material.

Figure 6:
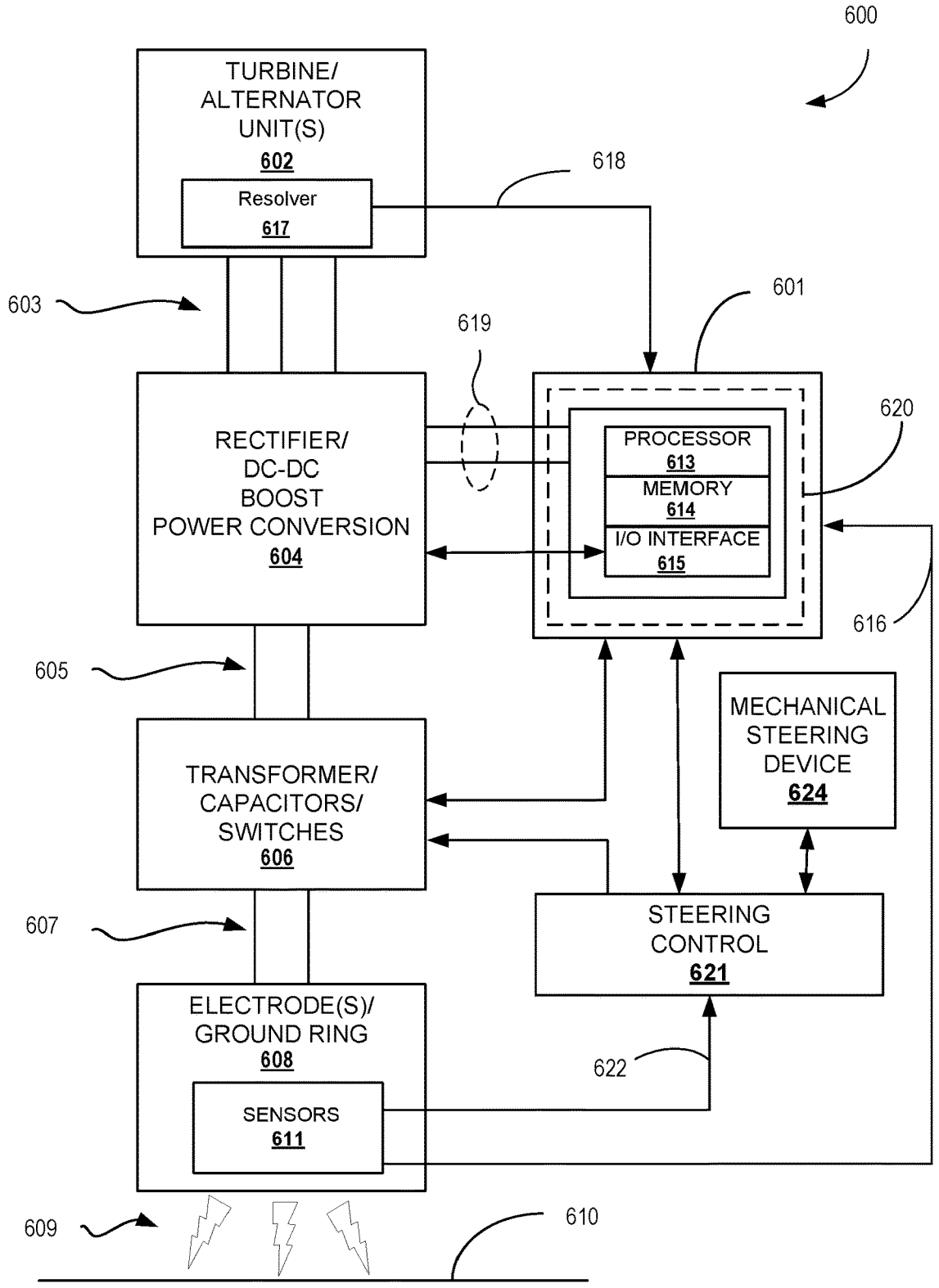
FIG. 6 illustrates a functional block diagram of various embodiments of a controller operating as a command receiver controller, and various electrical connections made to and from the controller that may be utilized within a pulse power drilling assembly, according to various embodiments.

FIG. 6 illustrates a functional block diagram of various embodiments of a controller operating as a command receiver controller 601, and various electrical connections made to and from the controller that may be utilized within a pulse power drilling assembly 600, according to various embodiments. The blocks illustrated in FIG. 6 are intended to represent functions or functional components provided by the components and devices that may be included in an assembly, such as pulse power drilling assembly 600, and are not necessarily representative of the actual devices or the type of components that may be utilized to perform these functions. As shown in FIG. 6, an assembly 600 may include a turbine and one or more alternator units (hereinafter "turbine/alternator units") 602. As described above, the turbine of the turbine/alternator units 602 may be mechanically rotated by a flow of drilling fluid passing through a turbine sub-section of the assembly 600. The mechanical rotation of the turbine is coupled to rotate a rotor portion of the alternator, in turn causing the alternator to generate an alternating current electrical output 603. The electrical output 603 from the alternator is conducted from the turbine/alternator units 602 to a Rectifier/DC-DC Boost Power Conversion block (hereinafter "rectifier block") 604. At the rectifier block 604, the electrical output 603 received from the turbine/alternator units 602 is rectified, for example using half or full wave rectification, and the rectified waveforms may be boosted to a higher voltage level, for example from 800 volts received at the rectifier block 604 to voltages in a range of 5-10 kilovolts. The rectified and boosted voltage waveforms may be output from the rectifier block and coupled to a transformer/capacitor block 606, as indicated a rectified electrical output 605.

The transformer/capacitor block 606 may include one or more banks of capacitors, i.e., primary capacitors such as the primary capacitors 136 of FIG. 1, which are coupled to the primary side of a transformer, and one or more banks of capacitor, i.e., secondary capacitors such as secondary capacitors 142 of FIG. 1, which are coupled to the secondary side of the transformer. The individual capacitor banks may include banks of capacitors that may be switchably coupled and disconnected relative to one another to provide the voltage, current, and capacitance requirements needed to charge and discharge these banks of capacitors, incorporating the operation of the transformer to further raise the voltage level of the electrical energy. Referring again to FIG. 6, control of the switches and the operation of the primary and secondary capacitors and the transformer are needed to controllably apply the electrical power received from the rectifier block 604 to the electrode(s)/ground ring (hereinafter "electrodes") 608 of the assembly 600 in the desired voltage/current configurations and in a desired manner with respect to pulse timing.

As part of operating the transformer/capacitor block 606, one or more switching devices may be controlled to couple the primary capacitors to the transformer and to controllably couple the secondary capacitors to the transformer. In addition, switching devices may be controlled to regulate the discharge of the electrical energy stored in the secondary capacitors, which may include voltage levels of 16-20 kilovolts, and apply that electrical energy to the electrodes 608 in one or more pre-determined patterns of electrical pulses, which is illustratively represented in FIG. 6 by the lightning bolts 609 extending from the electrodes 608 near the bottom of the figure. These controlled electrical pulses are configured to break up formation material 610 in the vicinity of the electrodes 608.

In order to provide control of the operation of the assembly 600, one or more controllers included in the assembly 600 may act as the command receiver controller 601. As illustrated in FIG. 6, the command receiver controller 601 may be coupled to one or more sensors 611 included in the assembly 600, and to one or more components included in the functional blocks illustratively represented in the figure. The sensors 611 are configured to measure one or more parameters of the discharges of the electrodes. The sensors may be one or more current sensors, voltage sensors, power sensors, phase sensors, frequency sensors, resistivity sensors, energy sensors, or any combination of such sensors. The command receiver controller 601 may include one or more processors 613, such as microprocessors, and other computer devices, such as computer memory 614, configured to store programing and other information related to the operation of the controller and the assembly 600, and an input/output interface 615. The input/output interface 615 may be configured to receive various signals, such as sensor output signals 616 that are provided by sensors 611 included as part of the assembly 600, and to provide output signals to one or more components, such as rectifier circuitry and switches, which are configured to control the operation of the one or more devices included in the assembly 600.

In various examples, the assembly 600 includes a resolver 617 configured to provide information, including rotational speed information (e.g., revolutions-per-minute) associated with the rotational speed of the turbine and/or the alternator. The resolver 617 may provide an output signal 618 that is coupled to the command receiver controller 601. The command receiver controller 601 may receive the output signal 618 from the resolver 617, and based on the received signal, may store information derived from the signal, and/or generate one or more output signals that are sent through the input/output interface 615 of the controller to other components of the assembly 600. These output signals may then be used to modify and control the operations being performed by these additional components based on the command signals issued by the command receiver controller 601.

In another example, the assembly 600 may include the sensors 611 configured to provide the output signal 616 that is indicative of the amount of current flow occurring during each of the pulsed electrical outputs 607 provided to the electrodes 608 of the assembly 600. This output signal 616 is coupled to the command receiver controller 601. Based on the sensed current levels detected for pulsed electrical outputs 607, the command receiver controller 601 may be configured to detect various parameters associated with the formation material in in the vicinity of the electrodes 608 and may for example be able to determine that a change in the type of rock present in the vicinity of the electrodes 608 has occurred as a result of advancement of the borehole being formed by the operation of the assembly 600. Other examples of sensor, sensor output signals, and the use of the information provided by and/or derived from the sensor output signals are possible and are contemplated in various embodiments of the controller or controllers operating as command receiver controller in an assembly.

In various embodiments, the assembly 600 may include a steering control 621. The steering control 621 may be configured to receive signals from the command receiver controller 601. The steering control 621 may provide steering control outputs based on the received signals to the command receiver controller. The steering control outputs may include commands to adjust a control parameter of the assembly, such as changing a direction or speed of drilling. The steering control parameter may also receive an output signal 622 from the sensors 611. The steering control 621 may include circuitry to process the received output signal 622 to determine a steering control output that may be sent to the command receiver controller 601. The steering 621 may also communicate a control output directly to the switches of the assembly. In addition to providing output signals to the command receiver controller 601 for further control of the electrical power being provided to the transformer/capacitor block 606, steering control 621 may also or in the alternative provide control signals to control the operation of mechanical steering devices 624 that are configured to physically direct the steering of the assembly, and thus the direction of the advancement of the borehole being advanced through the pulse power drilling operations being performed by assembly 600.

In various embodiments, the command receiver controller 601 may be powered by input power 619 provided by other circuitry included in the assembly 600, such as the rectifier 604 circuitry. In alternative embodiments, an on-board battery may be included in the controllers. The battery may be configured to provide the electrical power needed to operate the command receiver controller 601. The overall power requirements for operation of a controller included in an assembly may be relatively small, for example 30 watts total, or less than 100 watts total power per controller. In addition, the components included in the command receiver controller may be housed within shielding 620, such as a grounded box, a faraday cage, or similar structure designed to shield the components of the controller from electromagnet fields that may be present in the vicinity of the controller. Embodiments of the assembly 600 represented FIG. 6 may include more or less controllers configured in a same or similar manner as illustrated and described with respect to the command receiver controller 601 included in FIG. 6 and as described above.

Figure 7:
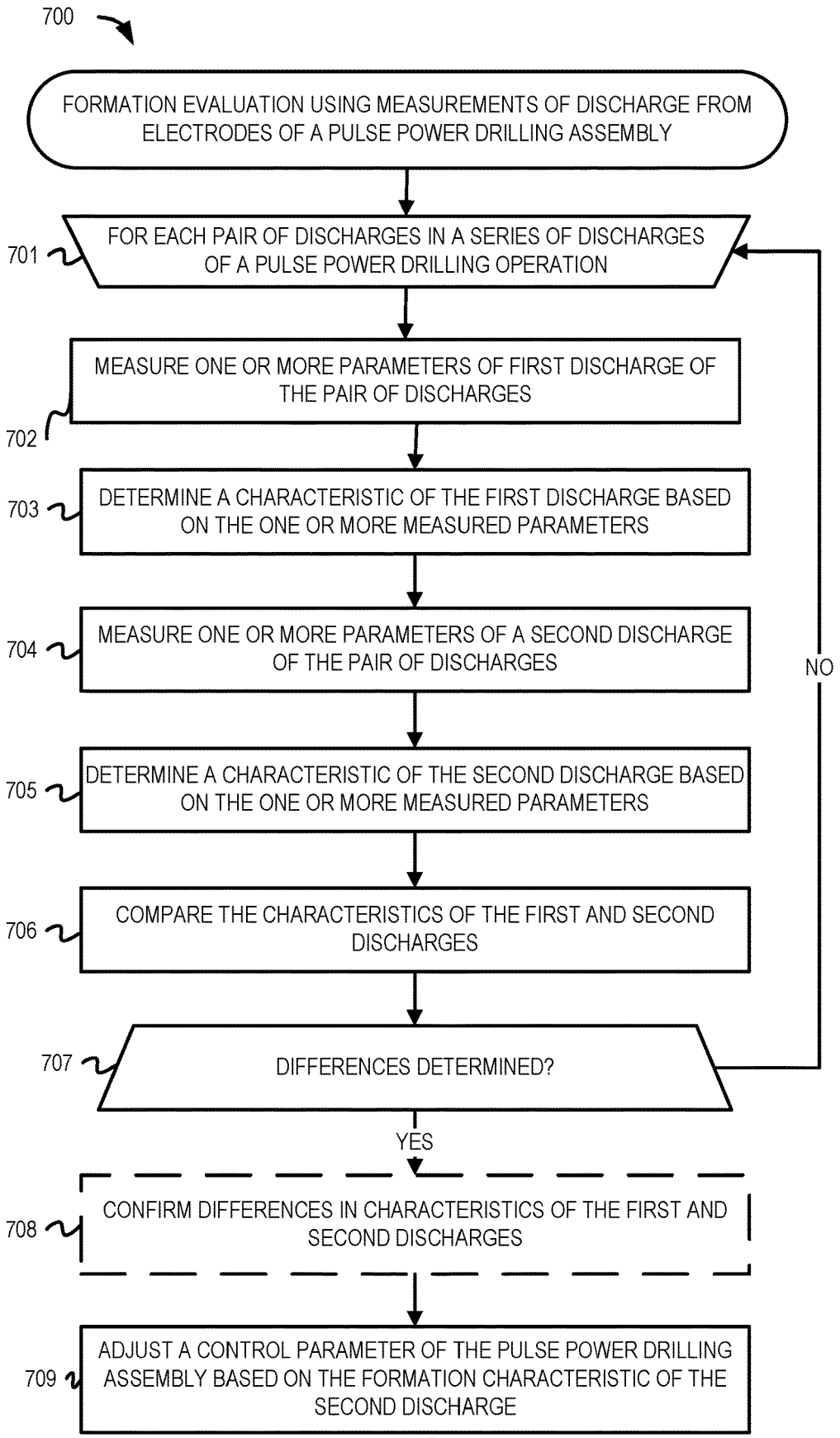
FIG. 7 depicts of flowchart of a method comprising operations for formation evaluation using measurements of a discharge from electrodes of a pulse power drilling assembly, according to various embodiments.

FIG. 7 depicts of flowchart of a method 700 comprising operations for formation evaluation using measurements of a discharge from electrodes of a pulse power drilling assembly, according to various embodiments. Operations of method 700 may be performed by system 100 of FIG. 1, assembly 202 of FIG. 2, and/or assembly 600 of FIG. 6. In various embodiments, operations of the method 700 begin at block 701.

At block 701, method 700 comprises selecting subsequent pairs of discharges in a series of discharges of a pulse power drilling operation. For example, a first pair of discharges may be the first discharge of a pulse power drilling operation and the second discharge may be the next discharge of the pulse power drilling operation. While the method 700 refers to a pair of discharges in the operations of blocks 701-707, the method 700 is not limited to two discharges. The operations of blocks 701-707 may be performed for any number of discharges in a series of discharges of a pulse power drilling operation. For example, three or more discharges may be used with operations similar to blocks 704-706 performed for each subsequent discharge. Additionally, the pair of discharges are not limited to a single discharge. Each discharge of the pair of discharges may also be a series of discharges in sequential order which are treated a one discharge either by averaging or by selecting one representative discharge from the series of discharges.

At block 702, method 700 comprises measuring one or more parameters of a first discharge of the pair of discharges. During pulse power drilling operations, electrode discharges are used to pulverize formation material to create a borehole. The formation material and/or fluids in the formation may influence parameters of the discharge of the electrodes during pulse power drilling operations. Sensors at or near the electrodes of the assembly, such as the sensors 611 of FIG. 6, may measure one or more parameters of the first discharge. The sensors may measure parameters of the discharge such as voltage, current, energy, frequency, and/or power. Additionally, measurements are not limited to a single parameter or set of parameters. For example, the sensors may measure more than one parameter simultaneously, such as voltage and power. The measured parameters may be communicated from the sensors to a controller, such as the command receiver controller 601 of FIG. 6, using a sensor output signal.

At block 703, method 700 comprises determining one or more characteristics of the formation material based on the measured parameters for the first discharge of the pair of discharges. One or more characteristics of the discharge may be selected by the controller for formation material evaluation. The one or more selected characteristics may be based in whole or in part on the measured parameters. The characteristics may be the measured parameter, or the one or more characteristics may also be derived from the measured parameters. For example, the characteristics may be a waveform, or a value calculated or derived from the measured parameters. The characteristics may be used to evaluate, characterize, and/or categorize the formation material. The characteristics may be compared to a template or look-up table to determine the formation type. Additional data or measurements may be combined to determine characteristics. The characteristics may also be used to determine formation boundaries or identify fluids present within a formation. The characterization may include determining at least one of a rock type, a rock family, and a presence of a fluid in the subterranean formation.

At block 704, method 700 comprises measuring the characteristic of a second discharge of the pair of discharges in the series of discharges of the pulse power drilling operation. The separation between the first discharge and the second discharge may be pre-determined with measurements occurring automatically at the pre-determined time intervals or the measurements may be initiated manually. The sensors measure the same parameter(s) of the second discharge as were measured for the first discharge in block 702. The measured parameter(s) may be communicated from the sensors to the controller using a sensor output signal.

At block 705, method 700 comprises determining one or more characteristics of the formation material based on the measured parameters for the second discharge of the pair of discharges, as described in block 703.

At block 706, method 700 comprises comparing the determined formation characteristic(s) of the first discharge and the second discharge. Changes in the type of formation material present in the location where the pulsed power drilling operations are occurring may result in changes of the measured parameters of the electrical pulses being applied to the formation material. By comparing the characteristics of the first discharge and second discharge, differences which may indicate a change in formation material can be detected. The characteristics may be processed by a processor of the controller for analysis. The controller may numerically compare the characteristics directly. The controller may also produce a graph or display of each of the characteristics, such as graph 300B, 400B, and 500B of FIGS. 3B, 4B, and 5B, respectively. The controller may then compare the processed data to determine differences between the characteristics. The controller may compare multiple characteristics related to the waveform of the measurements such as a length of a ring period, an amplitude of a ringing, a peak voltage, a frequency of a ringing, an overall shape of a waveform, a damping factor, etc.

At block 707, method 700 includes making a determination as to whether differences between the characteristics of the first and second discharge are detected. In various embodiments, if the characteristics are within a pre-determined threshold value, it is determined that the pulse power drilling assembly is still within the same formation material. The threshold value may be a percent difference or other statistical parameters. In various embodiments, if no differences are determined, operations may return to block 701 with a new pair of discharges as pulse power drilling operations advance the borehole. For example, operations may return to block using the second discharge and a subsequent third discharge as the pair of discharges for analysis.

In various embodiments, If the measured characteristics are not within the pre-determined threshold value, it is determined that the pulse power drilling assembly may have entered a new formation material. In this instance, operations continue to block 708.

At block 708, method 700 includes determining the differences in characteristics of the first and second discharges to determine formation material changes. Confirmation of differences may include comparing the discharges to previous or subsequent discharges to eliminate the possibility of outlier measurements or formation properties, as described in FIG. 3B. Confirmation may also include repeating blocks 701-707 for a set number of discharges before a determination is made. For example, in some instances, a difference may be determined based on only one pair of discharges being out of range. In other instances, a difference may not be confirmed until at least two or more discharges fall outside of the pre-determined threshold value. Confirmation may also include comparing the characteristics to data or geological surveys which may indicate known formation changes in the subterranean formation or similar subterranean formations.

In various embodiments of method 700, block 708 is optional. In various embodiments, falling outside of the predetermined threshold value for any pair of subsequent discharges will confirm differences that indicate a change in formation material. In these embodiments, operations will proceed from block 707 to block 709. In other instances, a second threshold value may set to indicate automatic procedure to block 709 from block 707. For example, a first threshold value may be set to confirm differences greater than 5% while a second threshold value may be set to automatically proceed to block 709 if differences are greater than 15%.

At block 709, method 700 comprises adjusting one or more control parameters of the pulse power drilling assembly based on the determined formation characteristic of the second discharge. The control parameter may be a geosteering operation which may include adjusting the speed of drilling and/or the direction of drilling. The control parameter may be adjusted automatically or manually. For example, the control parameter may automatically adjust the drilling speed after receiving an indication that the formation material has changed. The control parameter may also include an indication to stop drilling. For example, an indication to stop drilling may be desired when a certain formation material is reached. Because the measurements are taken at the electrodes at the downhole end of the pulse power drilling assembly, the information is received and processed faster than traditional logging while drilling (LWD) tools which may be a significant distance up the pulse power drilling assembly from the bottom of the borehole. this allows for more up-to-date and real-time measurements that can be used to accurately control the pulse power drilling assembly. For example, an indication of a fluid in the formation may be determined in block 704. The control parameter may be adjusted to stop drilling to prevent a flood of the fluid into the borehole. With traditional LWD tool, the fluid may not be detected until the drilling apparatus is well into the fluid containing formation which can cause a flood of fluids into the wellbore before the fluid is detected.

FIG. 7 is annotated with a series of reference numbers 701-705. These numbers represent stages of operations. Although these stages are ordered for this example, the stages illustrate one example to aid in understanding this disclosure and should not be used to limit the claims. For example, block 708 is optional. Subject matter falling within the scope of the claims can vary with respect to the order and some of the operations.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. With respect to FIG. 7, block 705 is optional. Operations of method 700 may end after block 704. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine-readable medium may be a machine-readable signal medium or a machine readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

Figure 8:
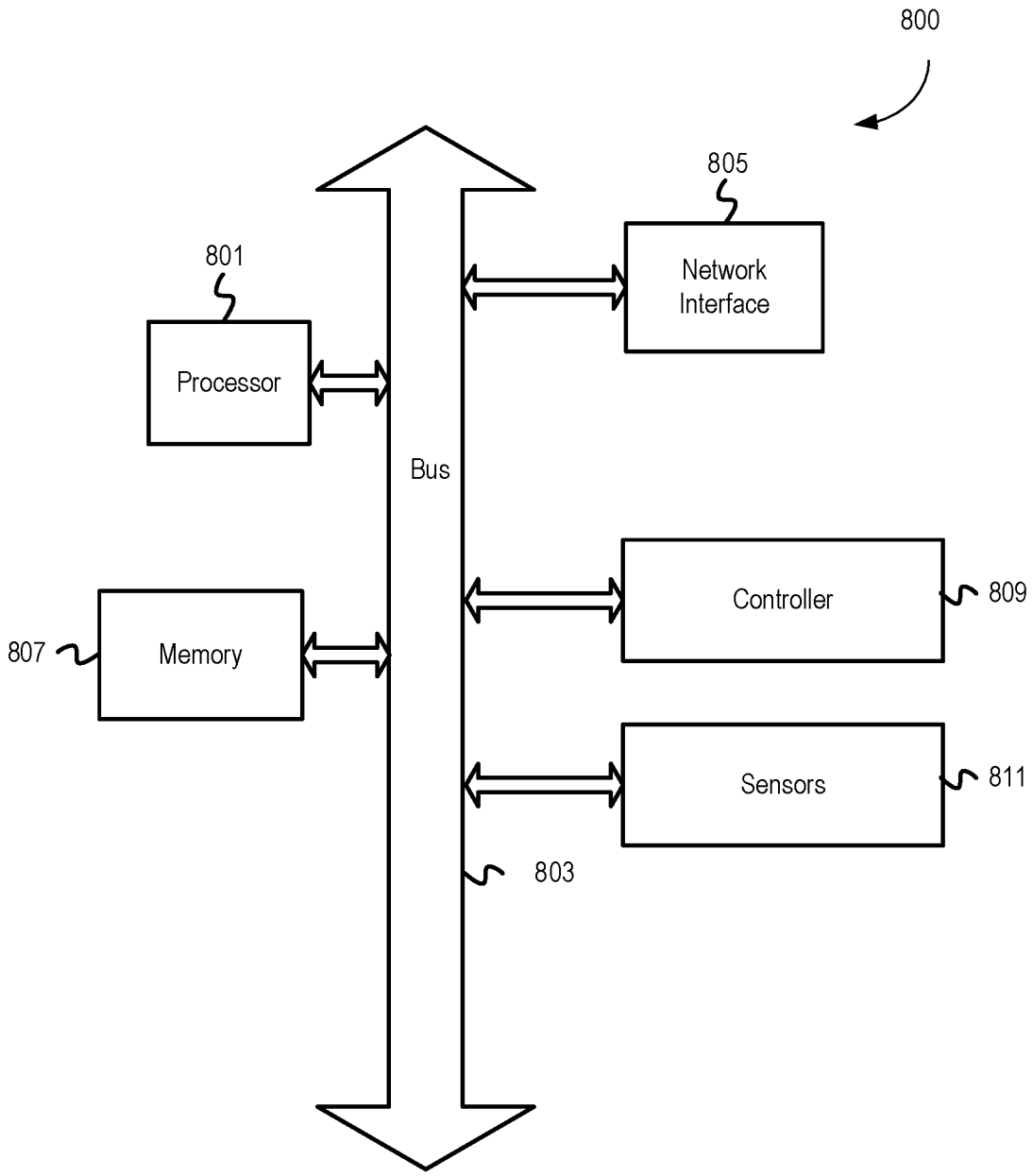
FIG. 8 depicts an example system for formation evaluation using measurements of a discharge from electrodes of a pulse power drilling assembly, according to various embodiments.

FIG. 8 depicts an example computer system 800 for formation evaluation using measurements of a discharge from electrodes of a pulse power drilling assembly, according to various embodiments. Embodiments of computer system 800, or variations thereof, may be representative of the types of system that include controller, processors, and other processor based circuitry that is described throughout this disclosure. As shown in FIG. 8, computer system 800 includes a processor 801 (possibly including multiple processors, multiple cores, multiple nodes, and/or implementing multi-threading, etc.). The computer system 800 includes memory 807. The memory 807 may be system memory or any one or more of the above already described possible realizations of machine-readable media. The computer system 800 also includes a bus 803 and a network interface 805. In various embodiments, computer system 800 communicates via transmissions to and/or from remote devices via the network interface 805 in accordance with a network protocol corresponding to the type of network interface, whether wired or wireless and depending upon the carrying medium. In addition, a communication or transmission can involve other layers of a communication protocol and or communication protocol suites (e.g., transmission control protocol, Internet Protocol, user datagram protocol, virtual private network protocols, etc.). The computer system 800 in various embodiments includes a controller 809. The controller 809 may be substantially similar to the command receiver controller 601 of FIG. 6. The controller 809 may perform operations of the method 700 of FIG. 7. The computer system 800 may also include one or more sensors 811. In various embodiments, the sensors 811 may be substantially similar to or the same as one or more of the current sensor 611 and/or the voltage sensor 612 of FIG. 6. The sensors 811 may be configured to send a sensor output signal to the controller 809. Any one of the previously described functionalities may be partially (or entirely) implemented in hardware and/or on the processor 801. For example, the functionality may be implemented with an application specific integrated circuit, in logic implemented in the processor 801, in a co-processor on a peripheral device or card, etc. Further, realizations may include fewer or additional components not illustrated in FIG. 8 (e.g., video cards, audio cards, additional network interfaces, peripheral devices, etc.). The processor 801 and the network interface 805 are coupled to the bus 803. Although illustrated as being coupled to the bus 803, the memory 807 may be coupled to the processor 801.

While the aspects of the disclosure are described with reference to various implementations and exploitations, it will be understood that these aspects are illustrative and that the scope of the claims is not limited to them. In general, techniques for formation evaluation and steering using discharge measurements from electrodes of a pulse power drilling assembly as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example Embodiments

A method comprises determining a first characteristic of a first discharge of electrodes of a pulse power drilling assembly in a borehole of a subterranean formation. The first characteristic is based on a measurement of the first discharge. The method comprises determining a second characteristic of a second discharge of the electrodes. The second discharge occurs after the first discharge, and the second characteristic is based on a measurement of the second discharge. The method comprises determining a difference between the first characteristic and the second characteristic and determining a boundary layer of the subterranean formation based on the difference.

The method further comprises characterizing the subterranean formation based on the first characteristic and characterizing the subterranean formation based on the second characteristic. Characterizing the subterranean formation comprises matching the first characteristic to a first template indicative of a formation material and matching the second characteristic to a second template indicative of a formation material. Characterizing the subterranean formation comprises determining at least one of a rock type, a rock family, and a presence of a fluid in the subterranean formation.

The method further comprises adjusting a control parameter of the pulse power drilling assembly based on the determined boundary layer.

The method further comprises measuring the first discharge and the second discharge at a face of the electrodes using at least one sensor.

The first characteristic and the second characteristic comprise at least one of a current measurement, a voltage measurement, an energy measurement, a power measurement, a resistivity measurement, and any value derived from the measurement of the first discharge and the second discharge.

A system comprises electrodes of a pulse power drilling assembly in a borehole of a subterranean formation, at least one sensor at a face of the electrodes, the at least one sensor to measure a parameter of a discharge of the electrodes during pulse power drilling operations, and a controller to receive a signal from the at least one sensor, the signals indicative of the parameter measurement. The controller comprises a processor and a machine-readable medium having program code executable by the processor to characterize the subterranean formation based on the received signal.

The system further comprises a turbine and an alternator. The turbine is mechanically rotated by a flow of drilling fluid through the pulse power drilling assembly. The alternator is coupled to the turbine. The alternator is to generate an electrical output to power the electrodes from the mechanical rotation of the turbine.

The system further comprises a transformer and at least one capacitor coupled to the alternator through a rectifier to control the electrical output to power the electrodes.

The machine-readable medium further comprises program code to determine a difference between the subterranean formation at a time of a first discharge of the electrodes and the subterranean formation at a time of a second discharge of the electrodes and determine a boundary layer of the subterranean formation based on the difference.

The machine-readable medium further comprises program code to adjust a control parameter of the pulse power drilling assembly based on the characterized subterranean formation.

The program code to characterize the subterranean formation comprises program code to match the measured parameter of the discharge to a template indicative of a formation material.

The program code to characterize the subterranean formation comprises program code to determine at least one of a rock type, a rock family, and a presence of a fluid in the subterranean formation.

The parameter comprises at least one of a current measurement, a voltage measurement, an energy measurement, a power measurement, and a resistivity measurement.

One or more non-transitory machine-readable media comprises program code for formation evaluation. The program code to determine a first characteristic of a first discharge of electrodes of a pulse power drilling assembly in a borehole of a subterranean formation. The first characteristic is based on a measurement of the first discharge. The program code is to determine a second characteristic of a second discharge of the electrodes. The second discharge occurs after the first discharge, and the second characteristic is based on a measurement of the second discharge. The program code is to determine a difference between the first characteristic and the second characteristic and determine a boundary layer of the subterranean formation based on the difference.

The one or more non-transitory machine-readable media further comprises program code to characterize the subterranean formation based on the first characteristic and characterize the subterranean formation based on the second characteristic.

The program code to characterize the subterranean formation comprises program code to match the first characteristic and the second characteristic to a template indicative of a formation material.

The one or more non-transitory machine-readable media further comprises program code to adjust a control parameter of the pulse power drilling assembly based on the determined boundary layer.

The one or more non-transitory machine-readable media further comprises program code to measure the first characteristic and the second characteristic at a face of the electrodes using at least one sensor.

What is claimed is:

1. A method comprising:

determining a first characteristic of a first discharge of electrodes of a pulse power drilling assembly in a borehole of a subterranean formation, wherein the first characteristic is based on a measurement of the first discharge;

determining a second characteristic of a second discharge of the electrodes, wherein the second discharge occurs after the first discharge, and wherein the second characteristic is based on a measurement of the second discharge;

determining that a difference between the first characteristic and the second characteristic has exceeded a threshold value; and determining a boundary layer of the subterranean formation based on the difference between the first and second characteristics of the first and second discharges.

2. The method of claim 1, further comprising:

characterizing the subterranean formation based on the first characteristic; and characterizing the subterranean formation based on the second characteristic.

3. The method of claim 2, wherein characterizing the subterranean formation comprises:

matching the first characteristic to a first template indicative of a formation material; and matching the second characteristic to a second template indicative of a formation material.

4. The method of claim 2, wherein characterizing the subterranean formation comprises determining at least one of a rock type, a rock family, and a presence of a fluid in the subterranean formation.

5. The method of claim 1, further comprising adjusting a control parameter of the pulse power drilling assembly based on the determined boundary layer.

6. The method of claim 1, wherein the first characteristic and the second characteristic comprise at least one of a current measurement, a voltage measurement, an energy measurement, a power measurement, a resistivity measurement, and any value derived from the measurement of the first discharge and the second discharge.

7. The method of claim 1, wherein the first characteristic and the second characteristic each comprise a peak voltage, a ring period, or a ring amplitude.

8. A system comprising:

electrodes of a pulse power drilling assembly in a borehole of a subterranean formation;

at least one sensor at a face of the electrodes, the at least one sensor to measure at least a first measurement and a second measurement of a parameter of a discharge of the electrodes during pulse power drilling operations; and a controller to receive one or more signals from the at least one sensor, the signals indicative of the parameter measurements, wherein the controller comprises a processor; and a machine-readable medium having program code executable by the processor to:

determine, based on the one or more signals, that a difference between the first measurement and the second measurement has exceeded a threshold value;

determine a boundary layer of the subterranean formation based on the difference between the first and second measurements of the parameter of the discharge; and characterize the subterranean formation based, at least in part, on the determined boundary layer and the difference.

9. The system of claim 8, further comprising:

a turbine, wherein the turbine is mechanically rotated by a flow of drilling fluid through the pulse power drilling assembly; and an alternator coupled to the turbine, wherein the alternator is to generate an electrical output to power the electrodes from the mechanical rotation of the turbine.

10. The system of claim 9, further comprising a transformer and at least one capacitor coupled to the alternator through a rectifier to control the electrical output to power the electrodes.

11. The system of claim 8, wherein the machine-readable medium further comprises program code to adjust a control parameter of the pulse power drilling assembly based on the characterized subterranean formation.

12. The system of claim 8, wherein the program code to characterize the subterranean formation comprises program code to match the measured parameter of the discharge to a template indicative of a formation material.

13. The system of claim 8, wherein the program code to characterize the subterranean formation comprises program code to determine at least one of a rock type, a rock family, and a presence of a fluid in the subterranean formation.

14. The system of claim 8, wherein the parameter comprises at least one of a current measurement, a voltage measurement, an energy measurement, a power measurement, and a resistivity measurement.

15. One or more non-transitory machine-readable media comprising program code for formation evaluation, the program code to:

determine a first characteristic of a first discharge of electrodes of a pulse power drilling assembly in a borehole of a subterranean formation, wherein the first characteristic is based on a measurement of the first discharge;

determine a second characteristic of a second discharge of the electrodes, wherein the second discharge occurs after the first discharge, and wherein the second characteristic is based on a measurement of the second discharge;

determine that a difference between the first characteristic and the second characteristic has exceeded a threshold value; and determine a boundary layer of the subterranean formation based on the difference between the first and second characteristics of the first and second discharges.

16. The one or more non-transitory machine-readable media of claim 15, further comprising program code to:

characterize the subterranean formation based on the first characteristic; and characterize the subterranean formation based on the second characteristic.

17. The one or more non-transitory machine-readable media of claim 16, wherein the program code to characterize the subterranean formation comprises program code to match the first characteristic and the second characteristic to a template indicative of a formation material.

18. The one or more non-transitory machine-readable media of claim 15, further comprising program code to adjust a control parameter of the pulse power drilling assembly based on the determined boundary layer.

19. The one or more non-transitory machine-readable media of claim 15, further comprising program code to measure the first characteristic and the second characteristic at a face of the electrodes using at least one sensor.

* * * * *